US008280078B2

(12) United States Patent
Yoshino

(10) Patent No.: US 8,280,078 B2
(45) Date of Patent: Oct. 2, 2012

(54) CAPACITOR MICROPHONE UNIT AND CAPACITOR MICROPHONE

(75) Inventor: Satoshi Yoshino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 203 days.

(21) Appl. No.: 12/899,818

(22) Filed: Oct. 7, 2010

(65) Prior Publication Data

US 2011/0103633 A1 May 5, 2011

(30) Foreign Application Priority Data

Oct. 30, 2009 (JP) ..... 2009-251204

(51) Int. Cl.
*H04R 25/00* (2006.01)

(52) U.S. Cl. ..... 381/174; 381/355; 381/356

(58) Field of Classification Search ..... 381/113, 381/116, 355, 356, 357, 358, 360, 369, 173, 381/174, 190, 191; 29/25.41, 25.42
See application file for complete search history.

(56) References Cited

U.S. PATENT DOCUMENTS 3,980,838 A * 9/1976 Yakushiji et al. ..... 381/191
6,985,597 B2 * 1/2006 Akino ..... 381/174
8,111,856 B2 * 2/2012 Shimura et al. ..... 381/356

FOREIGN PATENT DOCUMENTS

JP 2006-5710 1/2006

* cited by examiner

*Primary Examiner* — Huyen D Le

(74) *Attorney, Agent, or Firm* — Whitham Curtis Christofferson & Cook, PC

(57) ABSTRACT

Electro-acoustic converters each include a diaphragm, and a fixed electrode apart from the diaphragm for a certain distance and facing the diaphragm. The electro-acoustic converters are anteroposteriorly disposed on the same axis in a single casing, and are electrically connected in series. The front and rear converters each include impedance converters, and are serially connected with each other together with the impedance converters.

5 Claims, 13 Drawing Sheets

CAPACITOR MICROPHONE UNIT AND CAPACITOR MICROPHONE

BACKGROUND OF THE INVENTION

1. Field of the Invention

The present invention relates to a capacitor microphone unit that can have improved sensitivity while maintaining its excellent directional frequency response characteristics up to a high tone range and a capacitor microphone using such a capacitor microphone unit.

2. Description of the Related Art

A capacitor microphone unit is an electro-acoustic converter including a diaphragm and a fixed electrode facing each other with a certain space provided therebetween and utilizing a mechanism in which the capacity of a capacitor formed of the diaphragm and the fixed electrode changes when the diaphragm vibrates upon receiving sound wave. FIGS. 10A, 10B and 11 exemplary illustrate a conventional capacitor microphone unit.

As illustrated in FIGS. 10A, 10B, and 11, a cylindrical casing 101 incorporates a diaphragm ring 102, a diaphragm 103, a spacer 104, a fixed electrode 105, an acoustic resistor 106, a terminal 107, an insulating substrate 108, and a ring screw 109 in this order. The diaphragm 103 is made of a thin resin film having a surface on which a piece of metal is vapor deposited. The peripheral portion of the diaphragm 103 is fixedly adhered to the diaphragm ring 102. The casing 101 has a flange directed inward on one end, i.e., the front end that is on the left side in FIG. 11. The diaphragm ring 102 is in contact with the peripheral portion of the flanged portion. The spacer 104 of a thin ring-shaped plate is interposed between the diaphragm 103 and the fixed electrode 105, thereby forming a gap corresponding to the thickness of the spacer 104 between the diaphragm 103 and the fixed electrode 105. With this structure, an electret capacitor microphone can be provided by forming an electret layer on either of the surfaces of the diaphragm 103 and the fixed electrode 105 that are facing each other.

The terminal 107 penetrates the center hole of the insulating substrate 108 to have its rear end protrude towards the rear side of the microphone unit while the head portion on the front side of the terminal 107 is in contact with the fixed electrode 105. The acoustic resistor 106 is held by the insulating substrate 108 and defines an acoustic resistance in a space reaching the rear surface of the diaphragm 103 through a hole in the fixed electrode 105 from an acoustic terminal formed of a space provided in the insulating substrate 108. The ring screw 109 is screwed into the inner periphery at the rear end of the casing 101 to press the insulating substrate 108 towards the front side of the casing 101. With the above described elements being pressed with this pressing force, the diaphragm ring 102 is in contact with the inward-directed flange of the casing 101 and the elements are held in the casing 101 in a mutually pressed state.

The diaphragm ring 102 is electrically connected to the diaphragm 103 and the casing 101. Thus, a sound signal as a result of electro-acoustic conversion can be output from the casing 101 and through the terminal 107 electrically connected to the fixed electrode 105. Generally, an impedance converter such as a field electric transistor (FET) is provided to lower the impedance of the sound signal that is weak but has high impedance. An output circuit of a capacitor microphone using the above described capacitor microphone unit is exemplary illustrated in FIG. 12. In the output circuit, the fixed electrode 105 is connected to the input terminal of an impedance converter 110, the diaphragm plate 103 is connected to the ground side, and the primary coil of a transformer 111 is connected between an output terminal of the impedance converter 110 and the ground. The ends of the secondary coil of the transformer 111, respectively serving as a hot-side and a cold-side output terminals for a balanced output, are each connected to a microphone cable via a connector. The ground side is connected to a shielding cable of the microphone cable. Thus, balanced sound signal can be output.

Directional frequency response characteristics of a conventional capacitor microphone unit having the above described structure are depicted in FIG. 13. The thickest characteristic line represents the directional frequency response characteristic measured at the front of the microphone unit, i.e., the position that is not offset from the central axis of the microphone unit. The second thickest characteristic line represents the directional frequency response characteristic measured at a side of the microphone unit, i.e., the position offset from the central axis of the microphone unit by 90 degrees. The thin characteristic line represents the directional frequency response characteristic measured at the rear of the microphone unit, i.e., the position offset from the central axis of the microphone unit by 180 degrees. The characteristics were measured in accordance with EIAJ standard. Capacitor microphones are demanded to have improved sensitivity without degrading directional frequency response characteristics especially in a high frequency domain.

It is desirable that sensitivity of a microphone is high. Higher sensitivity can be provided to a capacitor microphone with the following possible measures:

1. increasing the driving force;
2. lowering the impedance of the microphone unit; and
3. providing the microphone unit with a diaphragm plate having a larger area.

It is most practical to provide higher sensitivity by providing the microphone unit with a diaphragm plate having a larger area among the measures. Unfortunately, this degrades the directional frequency response characteristics in a high frequency domain, i.e., sensitivity in a high frequency domain is degraded. Therefore, the inventors of the present invention have proposed an invention disclosed in Japanese Patent Application Publication 2006-5710 that relates to a capacitor microphone with which intrinsic noise can be reduced without degrading directional frequency response characteristics in a frequency domain including a high frequency domain. In the capacitor microphone according to such an invention, a plurality of small-diameter unidirectional capacitor microphone capsules (microphone units) is apposed, connected in parallel, and is connected to a single impedance converter.

The capacitor microphone described in Japanese Patent Application Publication 2006-5710 can solve the problem only to a certain level. More specifically, sensitivity over an expected level cannot be obtained because multiple microphone capsules are connected in parallel.

Therefore, the assignee filed a patent application, Japanese Patent Application Publication 2009-151768, on a capacitor microphone in which multiple microphone units are connected in series in an arrangement in which diaphragms of the respective microphone units are arranged to be on the same plane and an output from an impedance converter connected to one of the microphone units drives the ground side of another microphone unit. This application (hereinafter, referred to as prior invention) is not yet published at the point of the application of the present invention.

The capacitor microphone according to the prior application can improve the directional frequency response characteristics up to a high frequency domain while improving the sensitivity.

On the other hand, with the capacitor microphone according to the prior application, a new technical problem to be solved arises. Specifically, the size of the microphone applying this configuration is large because multiple microphone units are physically arranged in series.

SUMMARY OF THE INVENTION

An object of the present invention is to provide a capacitor microphone unit and a capacitor microphone that can have excellent directional frequency response characteristics in a frequency domain including a high frequency domain without having a large size (i.e., while solving the new technical problem), and a higher sensitivity without degrading the directional frequency response characteristics.

A capacitor microphone unit according to an aspect of the present invention includes: a casing; a plurality of electro-acoustic converters anteroposteriorly disposed on the same axis in the casing; and a spacer dividing the electro-acoustic converters. The electro-acoustic converters each includes: a diaphragm; a fixed electrode apart from the diaphragm for a certain distance and facing the diaphragm; an impedance converter; and terminals that are respectively connected to the diaphragm and the fixed electrode. The diaphragm and the fixed electrode of each of the electro-acoustic converters are electrically insulated from the casing. An output from the impedance converter connected to one of the electro-acoustic converters drives another one of the electro-acoustic converters.

In the capacitor microphone unit according to another aspect of the present invention, the electro-acoustic converters are electret capacitor microphone units.

In the capacitor microphone unit according to still another aspect of the present invention, the diaphragm ring of each of the electro-acoustic converters except for one of the electro-acoustic converters disposed at front most position is thinner than the diaphragm ring of the one of the electro-acoustic converters disposed at the front most position, the diaphragm ring being fixed to the diaphragm.

In the capacitor microphone unit according to yet still another aspect of the present invention, the capacitor microphone unit includes two capacitor microphone units described above. A plurality of electro-acoustic converters in one of the two capacitor microphone units and a plurality of electro-acoustic converters in the other one of the two capacitor microphone units are connected in series while being electrically opposite from each other. A balanced output is taken from the capacitor microphone unit with one of the two capacitor microphone units serving as a hot-side and the other one of the two capacitor microphone units serving as a cold-side.

A capacitor microphone according to an aspect of the present invention includes a casing; and the capacitor microphone unit described above incorporated in the casing.

The structure is such that in which a plurality of electro-acoustic converters is anteroposteriorly disposed on the same axis in the casing and each of the electro-acoustic converters includes the diaphragm and the fixed electrode apart from the diaphragm for a certain distance and facing the diaphragm. Therefore, the unit as a whole can be downsized with a diameter being the same as that of a general conventional capacitor microphone unit and the size in the axial direction being only slightly larger than a general conventional capacitor microphone unit.

Furthermore, the structure is such that the electro-acoustic converters are electrically separated by the spacer, the diaphragm and the fixed electrode of each of the electro-acoustic converters are electrically insulated from the casing, the terminals are respectively provided for the diaphragm and the fixed electrode, each of the electro-acoustic converters includes the impedance converter, and the output from the impedance converter connected to one of the electro-acoustic converters drives another one of the electro-acoustic converters. Thus, excellent directional frequency response characteristics up to a high frequency domain can be obtained and sensitivity can be improved with out degrading the directional frequency response characteristics.

DETAILED DESCRIPTION OF THE PREFERRED EMBODIMENTS

An embodiment of a capacitor microphone unit and a capacitor microphone is described below with reference to some of the accompanying drawings.

Figure 1A:
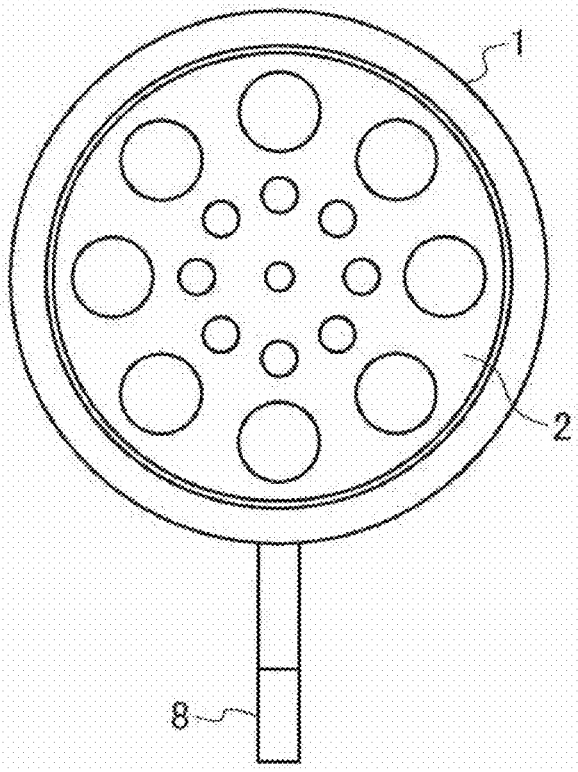
FIG. 1A is a front view of an embodiment of a capacitor microphone unit according to the present invention.
Figure 1B:
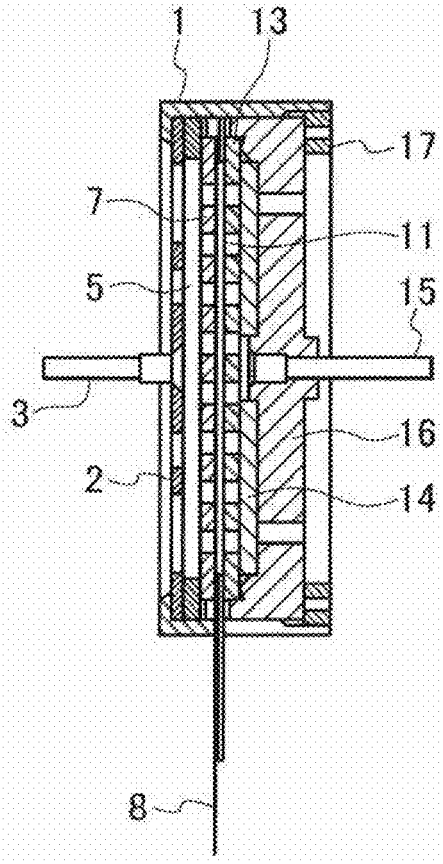
FIG. 1B is a cross-sectional side view of the embodiment.
Figure 2:
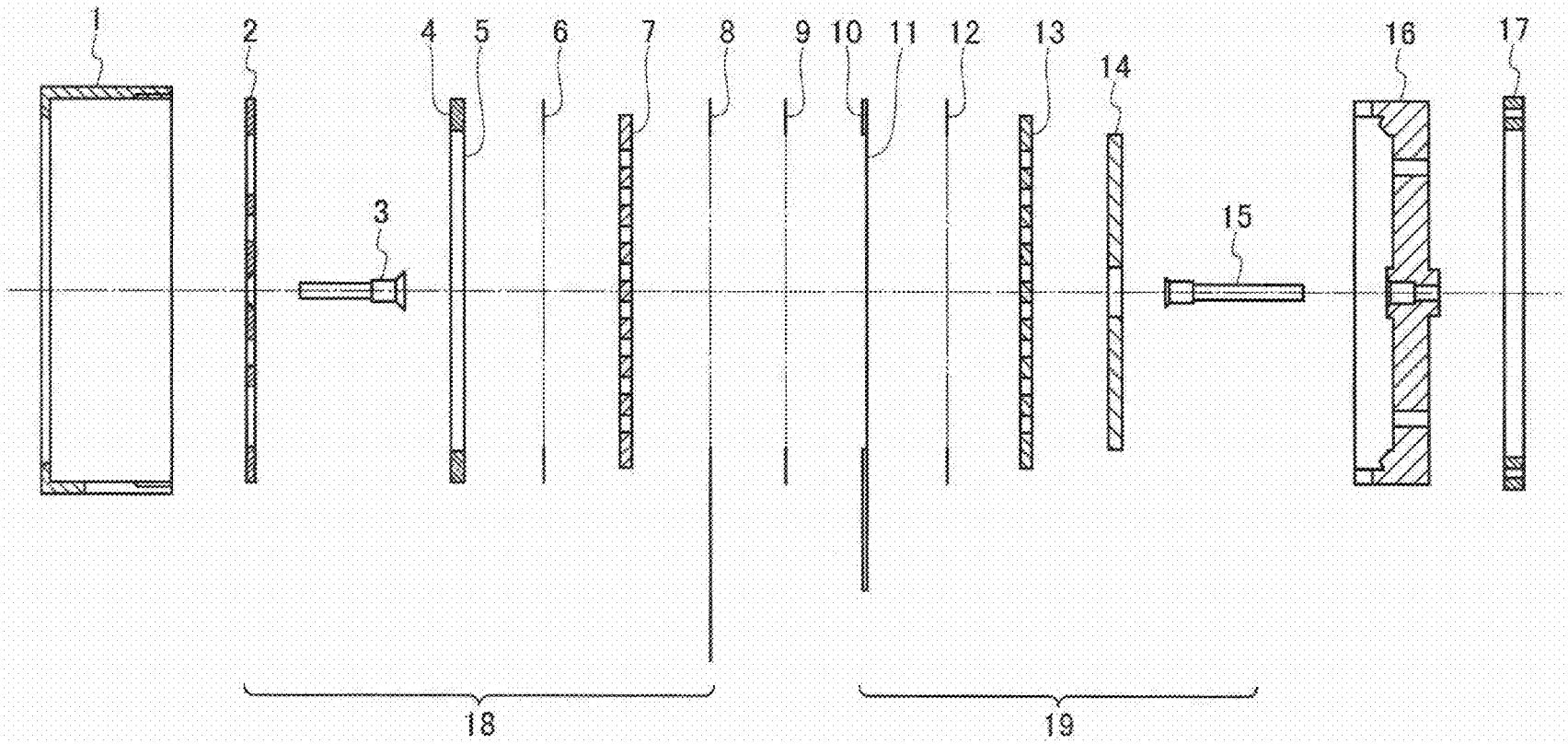
FIG. 2 is an exploded cross-sectional side view of the embodiment.

As illustrated in FIGS. 1A, 1B, and 2, a casing 1 has a cylindrical shape, is made of an insulating material, and sequentially incorporates a terminal plate 2, a terminal 3, a diaphragm ring 4, a diaphragm 5, a spacer 6, a fixed electrode 7, a terminal plate 8, a spacer 9, a diaphragm plate 10, a diaphragm 11, a spacer 12, a fixed electrode 13, an acoustic resistor 14, a terminal 15, an insulating substrate 16, and a ring screw 17. The diaphragms 5 and 11, each of which is made of a thin resin film, are fixed to the diaphragm rings 4 and 10, respectively, at their peripheral portions. The casing 1 has an inward-directed flange on one end (front end, which is the left end as viewed in FIG. 2). A peripheral portion of the terminal plate 2 is in contact with the inner surface of the flange. The spacer 6 is a thin ring shaped plate and is provided between the diaphragm 5 and the fixed electrode 7. As a result, a gap defined by the thickness of the spacer 6 is provided between the diaphragm 5 and the fixed electrode 7. Similarly, the spacer 12 is a thin ring shaped plate and is provided between the diaphragm 11 and the fixed electrode 13. As a result, a gap defined by the thickness of the spacer 12 is provided between the diaphragm 11 and the fixed electrode 13. An electret capacitor microphone unit is formed by providing an electret layer on either of the respective opposing surfaces of the diaphragm 5 and the fixed electrode 7 and on either of the respective opposing surfaces of the diaphragm 11 and the fixed electrode 13.

The terminal 3 having a circular rod shape penetrates the terminal plate 2 through the center hole thereof from the rear side to the front side of the terminal plate 2. The front end of the terminal 3 protrudes forward from the front end of the casing 1 and the rear end of the terminal 3 is in contact with the terminal plate 2 at its large diameter portion. The terminal plate 2 is electrically connected with the diaphragm 5 via the diaphragm ring 4, whereby the diaphragm 5 is electrically connected to the terminal 3. The terminal plate 8 having a ring shape is connected to the rear side of the fixed electrode 7, whereby the terminal plate 8 is electrically connected to the fixed electrode 7. The periphery of the terminal plate 8 partly protrudes radially outward through a notch formed on the casing 1. The protruding portion serves as an output terminal connected to the fixed electrode 7. A capacitor type electro-acoustic converter 18 is formed of the terminal plate 2, the terminal 3, the diaphragm ring 4, the diaphragm 5, the spacer 6, the fixed electrode 7, and the terminal plate 8. Hereinafter, this electro-acoustic converter may also be referred to as the front unit 18.

The terminal 15 having a round rod shape penetrates the insulating substrate 16 positioned on the right side as viewed in FIG. 2, through the center hole of the insulating substrate 16 from the front side toward the rear side. Thus, a tip of the terminal 15 protrudes from the rear side of the insulating substrate 16 while a large diameter portion of the terminal 15 contacts and presses the fixed electrode 13. As a result, the fixed electrode 13 and the terminal 15 are electrically connected to each other. The periphery of the diaphragm ring 10 partly protrudes radially outward through a notch formed on the casing 1. The protruding portion serves as an output terminal connected to the diaphragm 11. The acoustic resistor 14 is provided between the fixed electrode 13 and the insulating substrate 16 and the acoustic resistor 14 provides an acoustic resistance for an acoustic terminal formed of a hole on the insulating substrate 16.

A capacitor type electro-acoustic converter 19 is formed of the diaphragm ring 10, the diaphragm 11, the spacer 12, the fixed electrode 13, the acoustic resistor 14, and the terminal 15. Hereinafter, this electro-acoustic converter may also be referred to as the rear unit 19.

The spacer 9 is provided between the front unit 18 and the rear unit 19 to divide the units on the front side and the back side. The ring screw 17 is screwed into the inner surface of the rear end (right side as viewed in FIG. 2) of the casing 1 to press the insulating substrate 16 towards the front. With the pressing force thus applied, the above described elements in the casing 1 are pressed towards the front and the terminal plate 2 contacts the inward-directed flange of the casing 1. Thus, the elements are positioned and held in the casing 1 in a mutually contacted state. Accordingly, the front and the rear electro-acoustic converters 18 and 19 are incorporated in the casing 1 while being disposed anteroposteriorly on the same axis and being is serial connection. An output signal from the front unit 18 is taken from the terminal 3 and the terminal plate 8. An output signal from the rear unit 19 is taken from the terminal 15 and the diaphragm ring 10. Accordingly, the structure is such that the diaphragms 5 and 11 and the fixed electrodes 7 and 13 of the respective electro-acoustic converters 18 and 19 are insulated from the casing 1 and terminals connected to the respective diaphragms 5 and 11 and the respective fixed electrodes 7 and 13 are separately provided.

Figure 3:
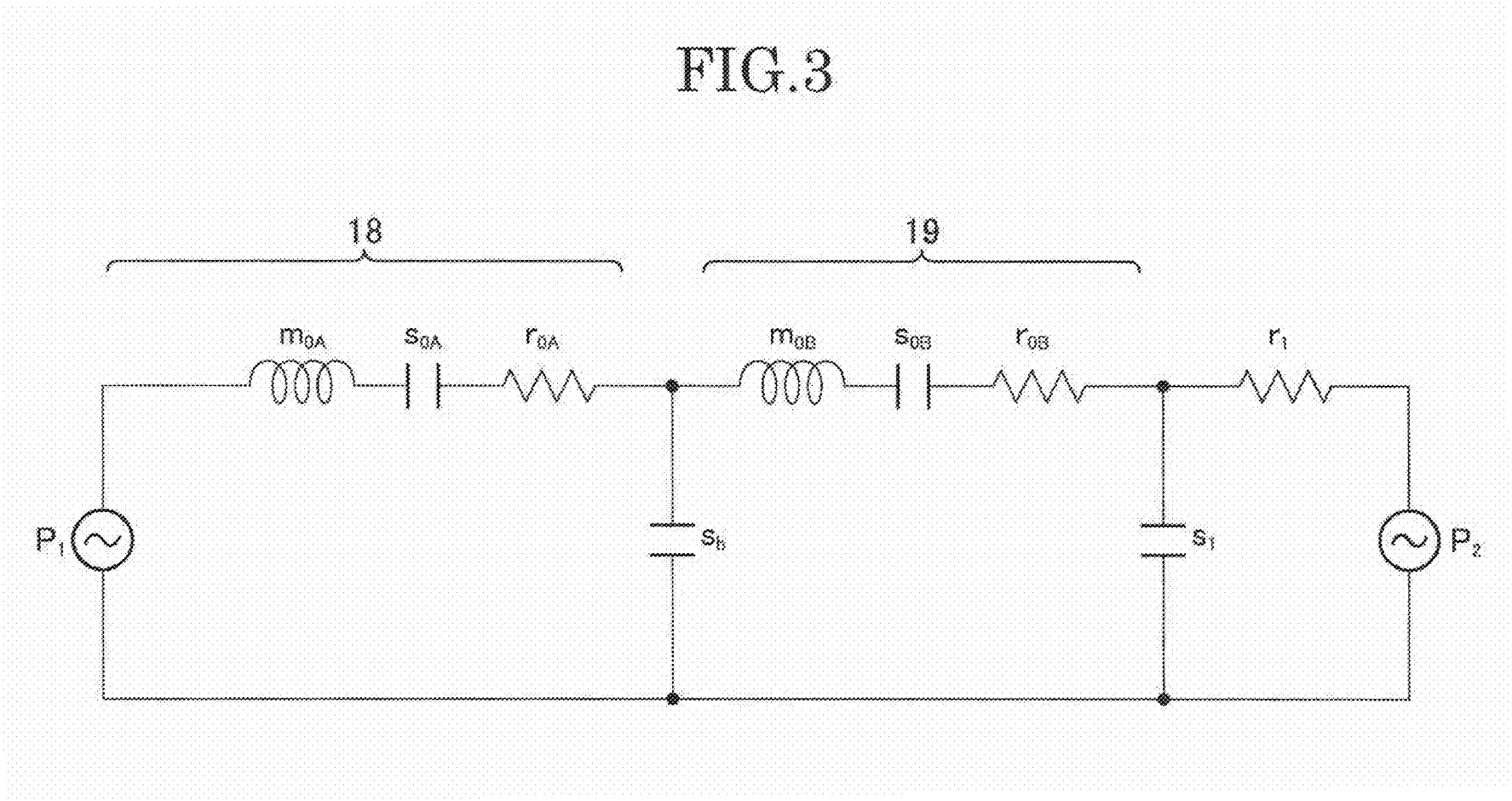
FIG. 3 is an acoustic equivalent circuit diagram of the capacitor microphone unit according to the present invention.

FIG. 3 illustrates an acoustic equivalent circuit according to the embodiment. $S_b$ represents the stiffness of a space formed of a space between the front diaphragm 5 and the fixed electrode 7, a hole provided in the fixed electrode 7, and a space between the fixed electrode 7 and the rear diaphragm 11. The stiffness $S_b$ serves as a border line between the front and the rear units 18 and 19 connected with each other. $P_1$ represents sound pressure of the front unit 18. $m_{OA}$, $S_{OA}$, and $r_{OA}$ respectively represent a mass, stiffness, and an acoustic resistance of an air chamber of the front unit 18. $P_2$ represents sound pressure of the front unit 19. $m_{OB}$, $S_{OB}$, and $r_{OB}$ respectively represents a mass, stiffness, and an acoustic resistance of an air chamber of the front unit 19. $S_1$ represents a stiffness of the hole provided on the fixed electrode 13 and a rear air chamber communicating with the hole. $r_1$ represents an acoustic resistance value of the acoustic resistor 14.

Figure 4:
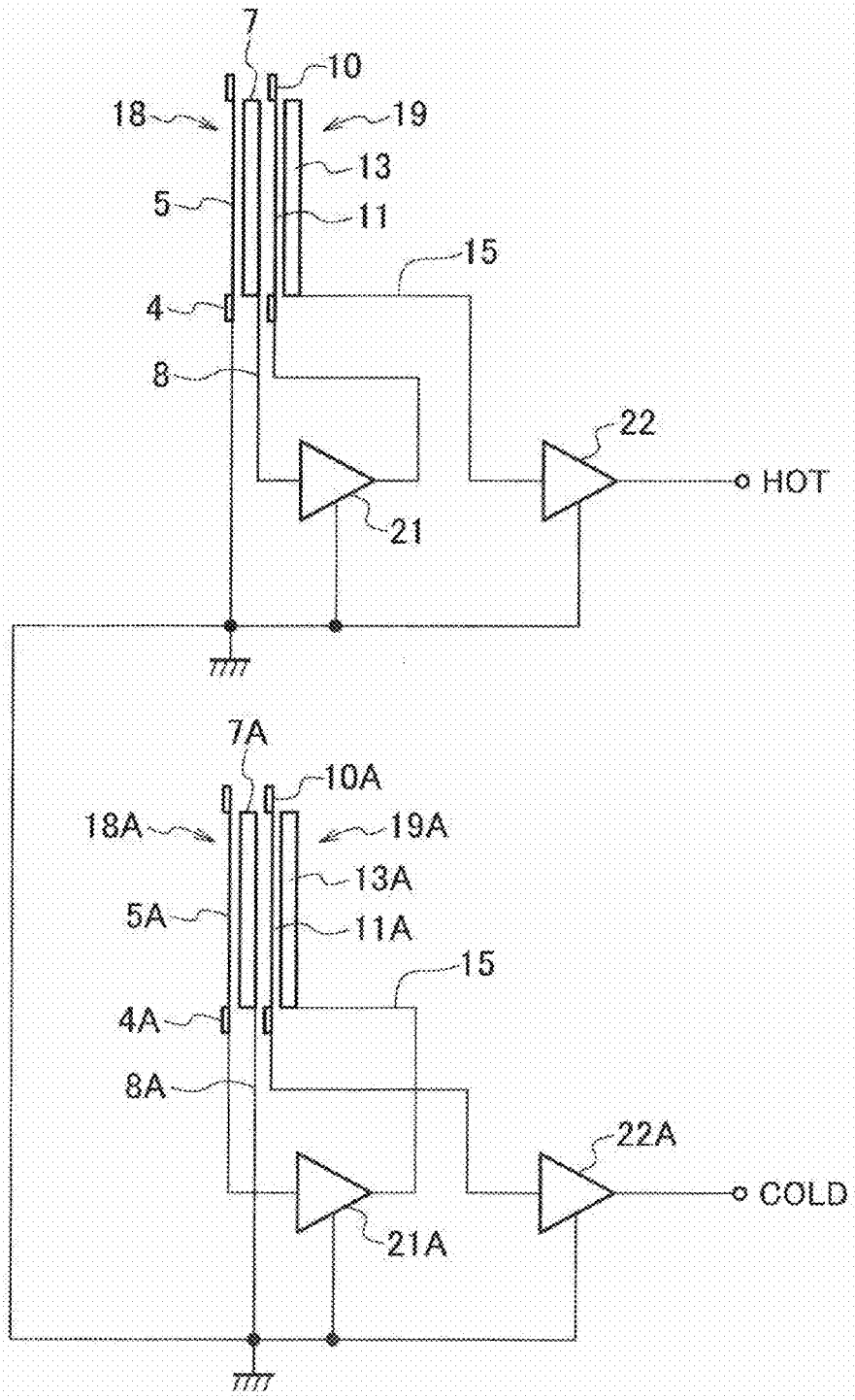
FIG. 4 is a circuit diagram exemplary depicting an electrical connection of the capacitor microphone unit according to the present invention.

An example of an electrical connection of the embodiment is described with reference to FIG. 4. In the example illustrated in FIG. 4, two above described capacitor microphone units are used for balanced output. First, an example of an output circuit of one of the microphone units that is on the upper side in FIG. 4 is described. In FIG. 4, the diaphragm 5 and the fixed electrode 7 form the main portion of the front unit 18 while the diaphragm 11 and the fixed electrode 13 form the main portion of the rear unit 19. As described above, the diaphragm 5 of the front unit 18 is connected to the outside of the unit via the diaphragm ring 4, terminal plate 2, and the terminal 3 and is grounded as illustrated in FIG. 4. The fixed electrode 7 is connected to outside of the unit through the terminal plate 8 and is connected to the input terminal of the impedance converter 21. The output terminal of the impedance converter 21 is connected to the diaphragm 11 through the diaphragm ring 10 of the rear unit 19. The fixed electrode 13 of the rear unit 19, which is connected to the outside of the unit via the terminal 15, is connected to the input terminal of the impedance converter 22. The output terminal of the impedance converter 22 serves as a signal output terminal for one capacitor microphone unit in which the front and the rear units 18 and 19 are connected in series.

As described above, the front and the rear units 18 and 19 are incorporated in a single casing. The front and the rear units 18 and 19 are disposed on the same axis in a physical sense, include the impedance converters 21 and 22, respectively in an electrical sense, and are serially connected together with the impedance converters 21 and 22. In other words, multiple diaphragms and respective multiple fixed electrodes facing the diaphragms and are insulated from one another and anteroposteriorly arranged on the same axis in a single casing. Electro-acoustic converters are divided by a spacer. The diaphragm and the fixed electrode of each of the electro-acoustic converter are electrically insulated from the casing and respective terminals connected to the diaphragm and the fixed electrode are separately provided. The electro-acoustic converters each includes an impedance converter and an output from the impedance converter connected to one of the electro-acoustic converters drives the other electro-acoustic converter. By connecting multiple electro-acoustic converters electrically in series as described above, an output voltage of N fold, i.e., 20 logN (N=2, 3, . . . ), can be obtained where N is the number of units connected in series. This means the increase for 10 logN because intrinsic noise is uncorrelated, thereby improving the S/N ratio.

The fixed electrodes 7 and 13 of the respective front and rear units 18 and 19 are provided with multiple holes through which the front and the rear units 18 and 19 are acoustically connected in series. The diaphragm ring 10 of the rear unit 19 is thinner than the diaphragm ring 4 of the front unit 18 so that the space between the front fixed electrode 7 and the rear diaphragm 11 is small to have higher stiffness ($S_b$ in FIG. 3). Not only in the structure in which two units are anteroposteriorly disposed as in the illustrated embodiment, but also in a general structure in which multiple electro-acoustic converters are anteroposteriorly disposed, the electro-acoustic converter provided behind the one at the front most position may have a diaphragm ring thinner than the electro-acoustic converter of the front most one.

The thickness of the diaphragm ring of the electro-acoustic converter except for the front most one preferably is at the smallest possible limit for maintaining certain strength to prevent response characteristics for high frequencies from degrading. Diaphragm rings manufactured in a conventional method, i.e., machining, cannot have a thickness below a certain level while maintaining its strength. Therefore, a diaphragm ring haying small thickness as much as possible while maintaining certain strength to be suitable for the electro-acoustic converters except for the front most one should be manufactured by etching a metal plate. With the diaphragm ring 10 of the rear unit 19 having as small thickness as much as possible, the response characteristics of the rear unit 19 for high frequency domain are prevented from degrading. The diaphragm ring 10 of the rear unit 19 has a thickness of about 200 micrometers while a general diaphragm ring has a thickness of about 800 micrometers. In the embodiment, the diaphragm ring 10 of the rear unit 19 has a thickness of 200 micrometers and is made by etching a brass plate and gold-plating the resultant object.

Figure 5:
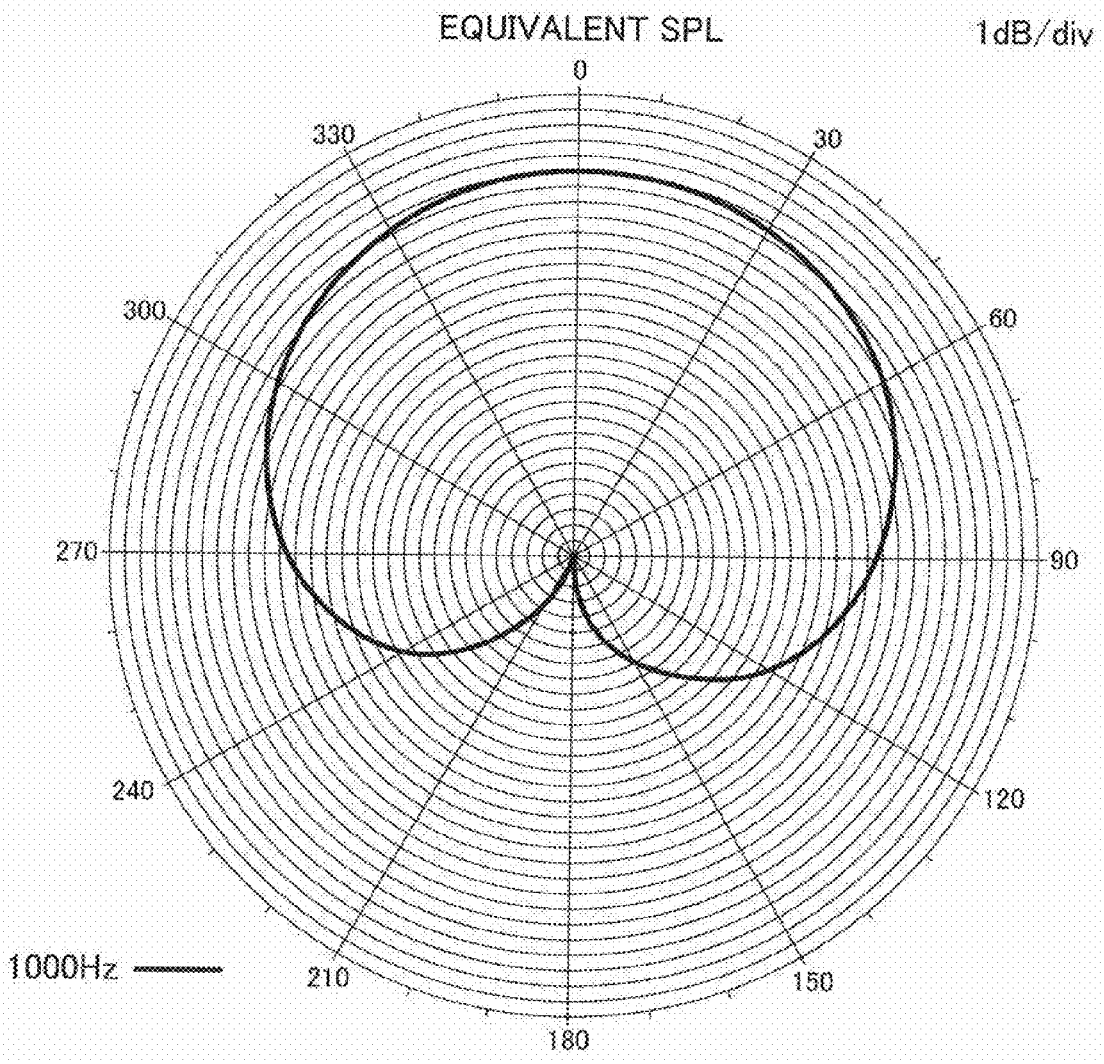
FIG. 5 is a diagram illustrating a directional characteristic of a front-side unit of the capacitor microphone unit according to the present invention.
Figure 7:
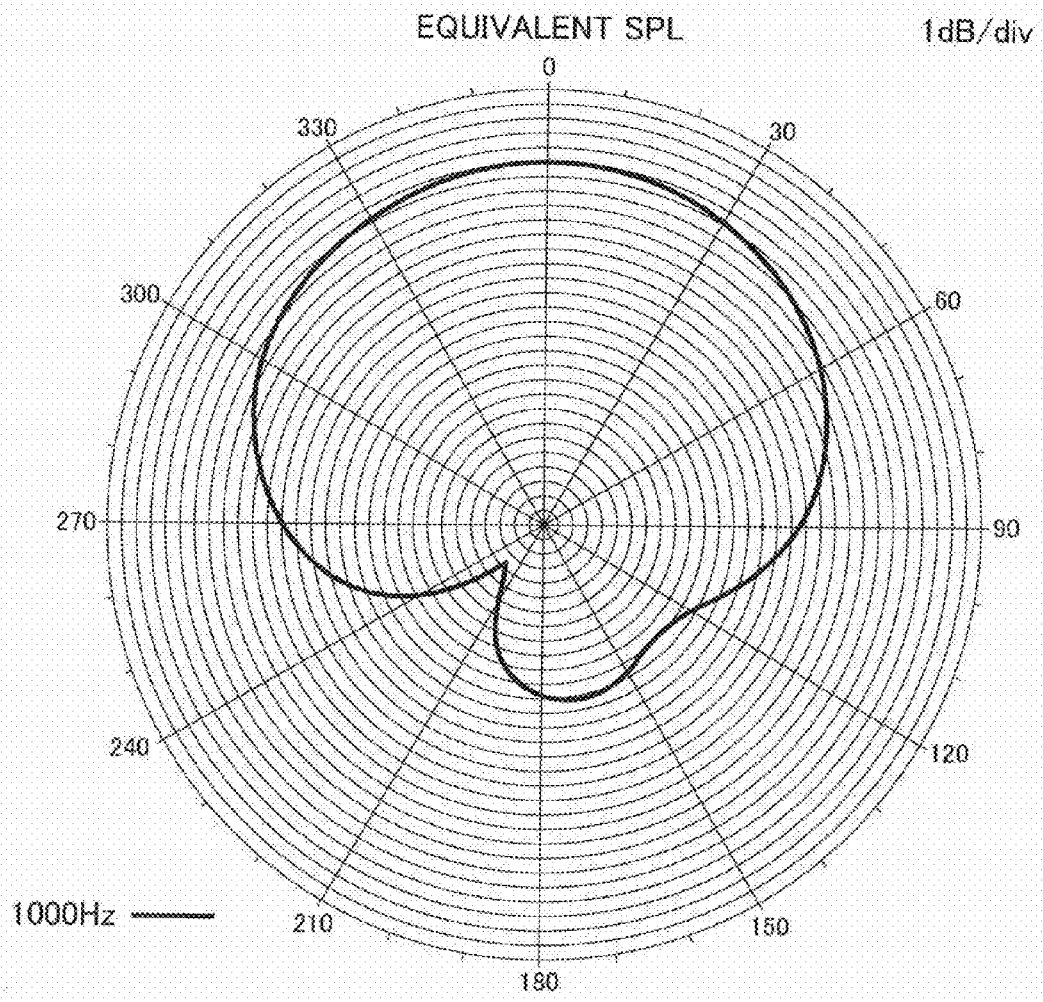
FIG. 7 is a diagram illustrating a directional characteristic of a rear-side unit of the capacitor microphone unit according to the present invention.

For the diaphragm 11 of the rear unit 19, the space between the fixed electrode 7 and the diaphragm 5 of the front unit 18 and the space between the fixed electrode 7 and the diaphragm 11 of the rear unit 19 serve as front acoustic resistors. Accordingly, directionality of the rear unit 19 is more bidirectional compared with that of the front unit 18. FIGS. 5 and 7 depict the directionalities of the front and the rear units 18 and 19 of the embodiment, respectively. As described above, the directionality of the rear unit 19 depicted in FIG. 7 is more bidirectional compared with that of the front unit 18 depicted in FIG. 5. The front and the rear units 18 and 19 are connected in series and the output signals are synthesized. Thus, resistance of the acoustic resistor 14 provided at the rear side is appropriately adjusted to provide the synthesized output signal with desired directionality, e.g.; cardioide.

Furthermore, outputs from the units 18 and 19 can be independently taken. Thus, directional characteristics such as wide cardioide and cardioide can be obtained by selecting the either of the outputs from units 18 and 19 or mixing the outputs. By further adjusting the resistance of the acoustic resister 14, directionalities such as cardioide and super cardioide can be obtained.

Figure 6:
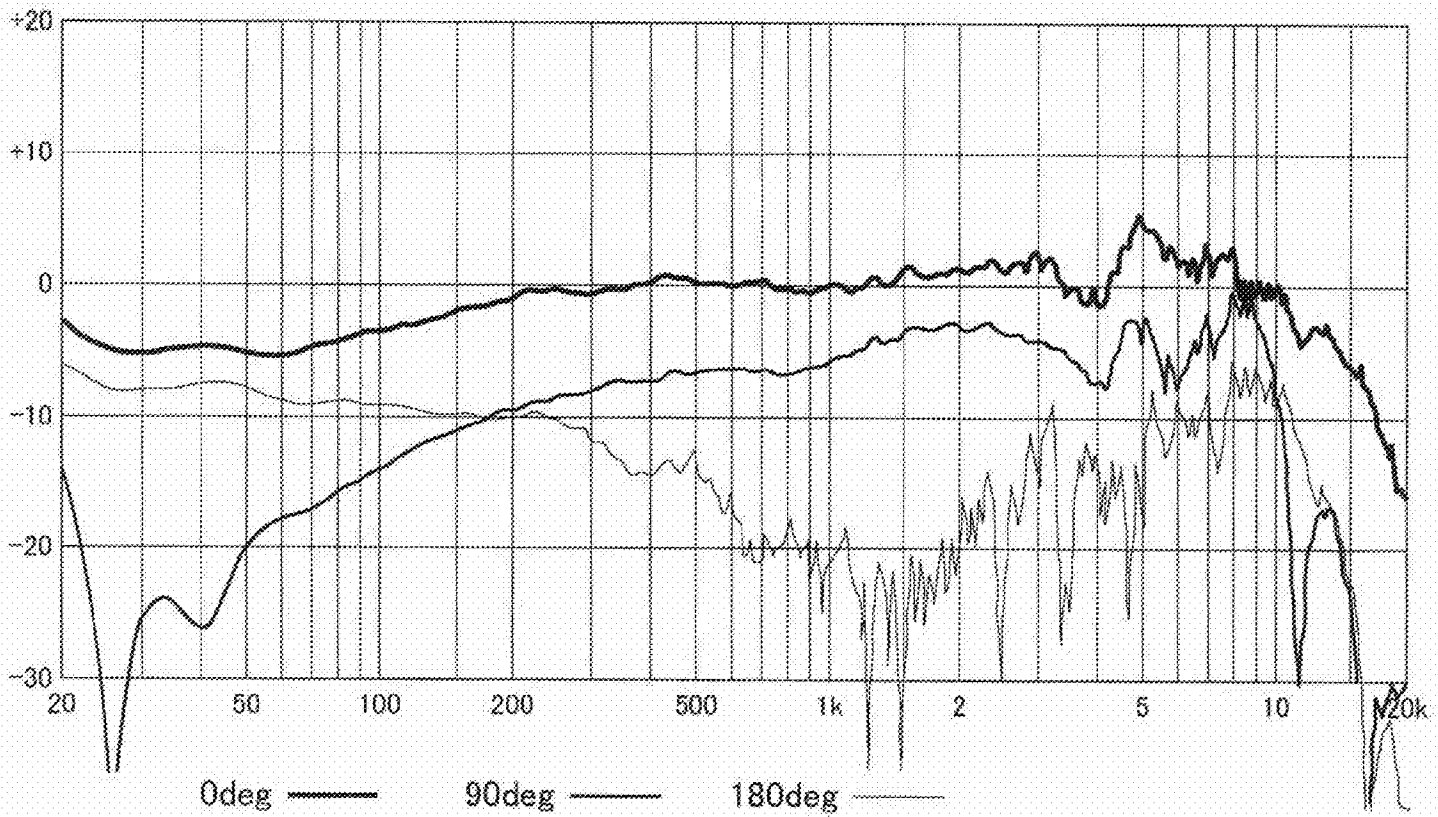
FIG. 6 is a graph depicting frequency responses of the front-side unit.
Figure 8:
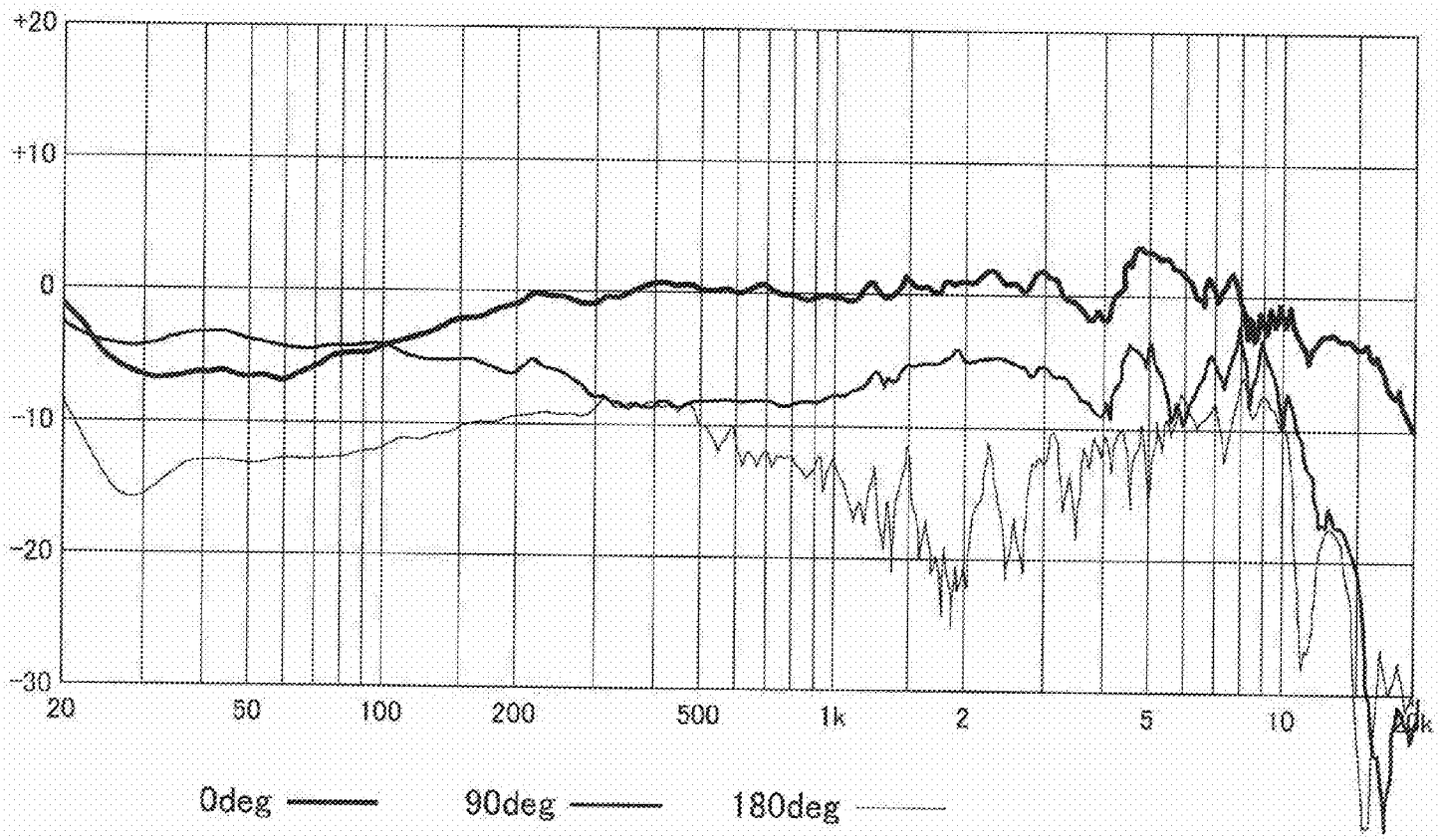
FIG. 8 is a graph depicting frequency responses of the rear-side unit.
Figure 9:
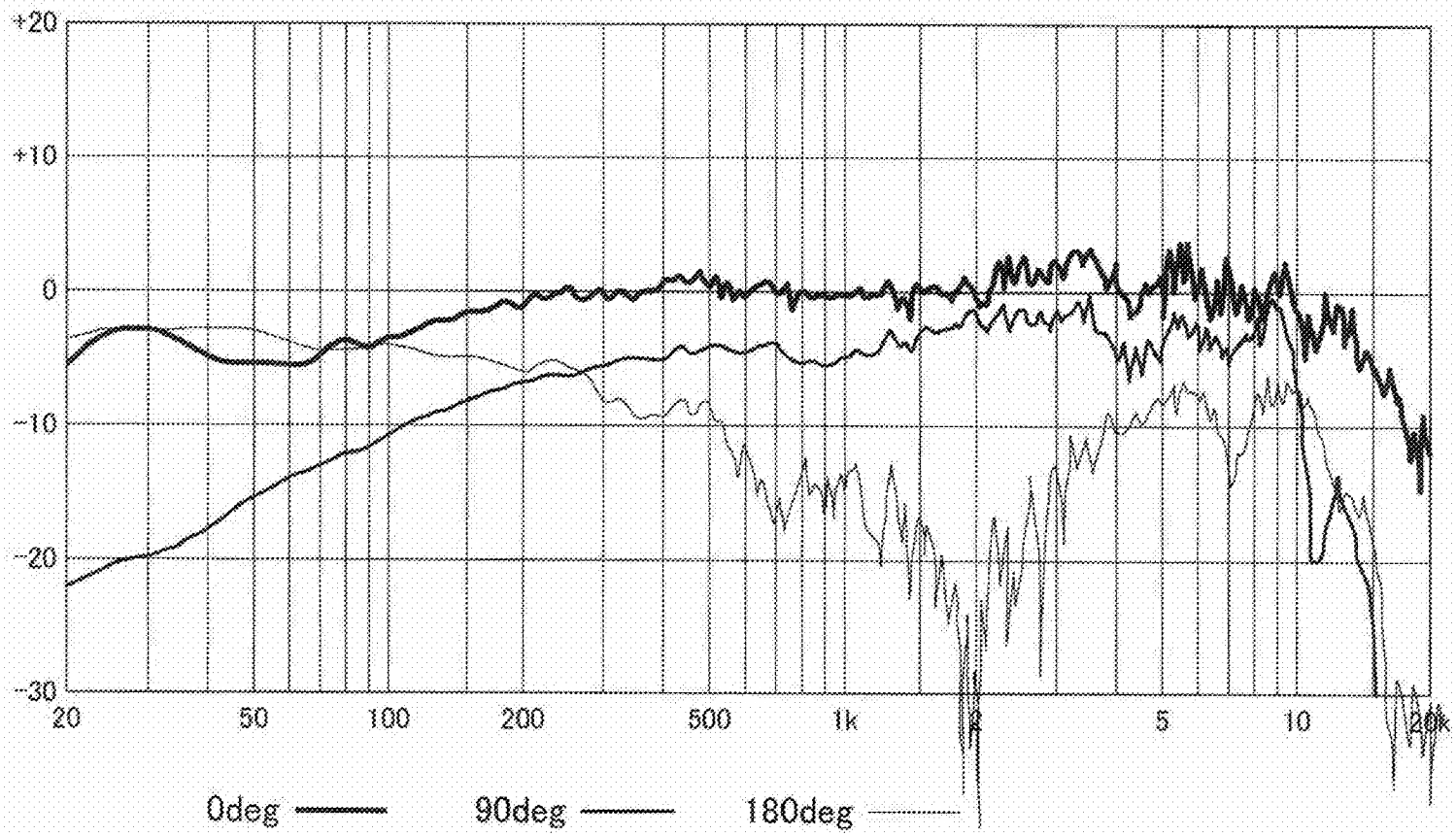
FIG. 9 is a graph depicting frequency responses of the capacitor microphone unit according to the present invention with the front-side unit and the rear-side unit combined.
Figure 10A:
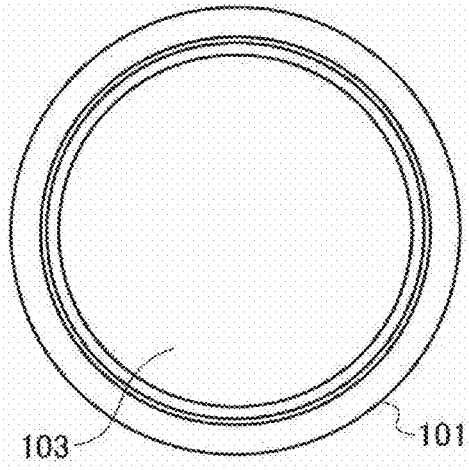
RELATED ART FIG.10A
FIG. 10A is a front view of an example of a conventional capacitor microphone unit.
Figure 10B:
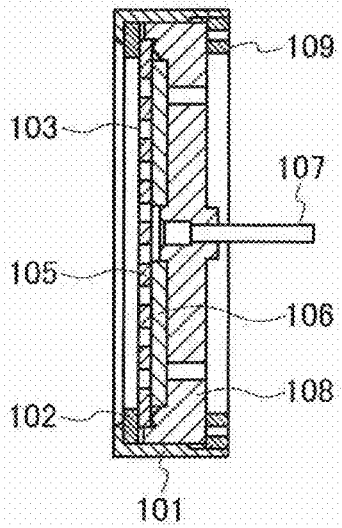
FIG. 10B is a cross-sectional side view of the conventional capacitor microphone unit.
Figure 11:
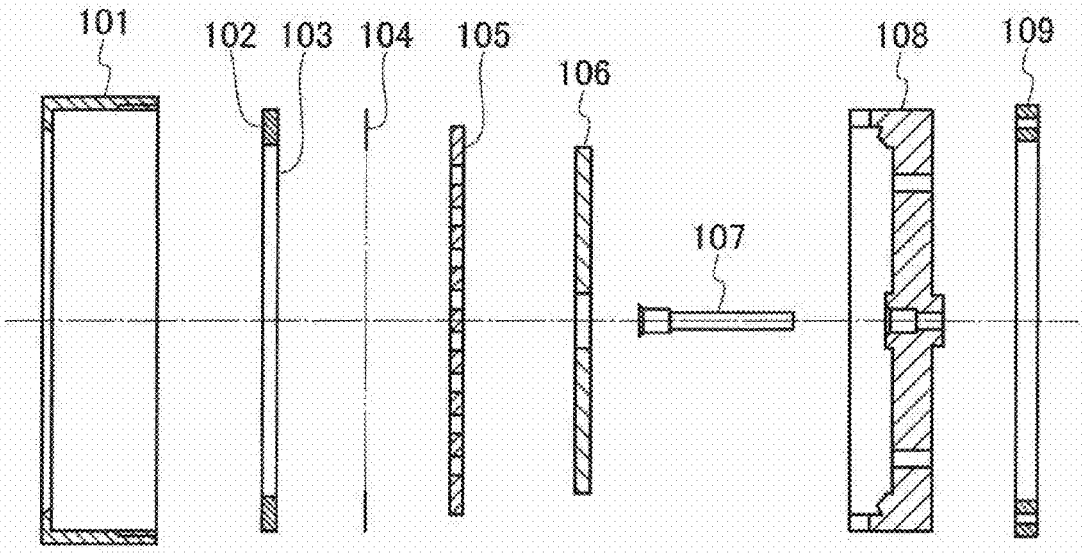
RELATED ART FIG.11
FIG. 11 is an exploded cross-sectional side view of the conventional example.
Figure 13:
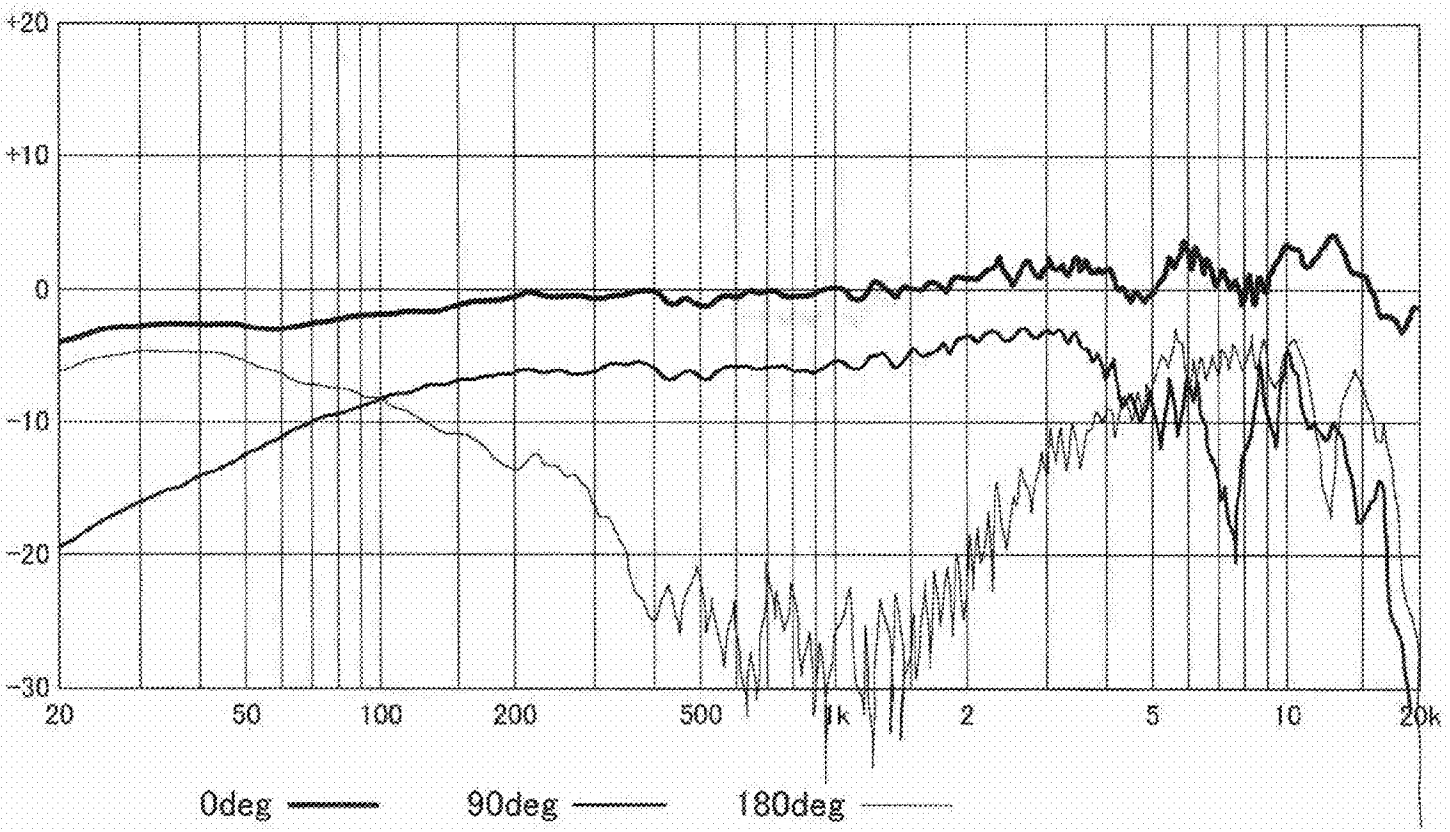
RELATED ART FIG.13
FIG. 13 is a graph depicting frequency responses of the conventional capacitor microphone unit.

FIGS. 6 and 8 depict the frequency responses of the front and the rear units 18 and 19, respectively. FIG. 9 depicts the frequency response of the synthesized output obtained from the front and the rear units 18 and 19 connected in series as illustrated in the upper part of FIG. 4. In FIGS. 6, 8, and 9, the thickest characteristic line represents the frequency response measured at the front of the microphone unit, i.e., the position that is not offset from the central axis of the microphone unit. The second thickest characteristic line represents the frequency response measured at a side of the microphone unit, i.e., the position offset from the central axis of the microphone unit by 90 degrees. The thin characteristic line represents the frequency response measured at the rear of the microphone unit, i.e., the position offset from the central axis of the microphone unit by 180 degrees. The frequency responses were measured in accordance with EIAJ standard as in the case of the frequency responses of the conventional example depicted in FIG. 13. Through comparison between FIGS. 9 and 13, improved sensitivity of the embodiment of the present invention can be confirmed.

Returning to FIG. 4, this structure has one capacitor microphone unit made by incorporating the front and the rear units 18 and 19 in a single casing 1 on the upper part as described above, and has another capacitor microphone unit on the lower side. With the capacitor microphone units in a pair, balanced output can be taken from the system. The upper and the lower capacitor microphone units in FIG. 4 have the same physical configuration. Therefore, the elements in the lower capacitor microphone units are given the same reference numerals for those in the upper side counterpart except for that a character "A" is provided behind each of the numerals.

As described above, the units 18 and 19 of the upper capacitor microphone unit is connected in series together with their impedance converters. The units of the lower capacitor microphone unit are also connected in series together with their impedance converters but in a reversed manner from the upper counterpart. Specifically, a fixed electrode 7A of the front unit is grounded and a diaphragm 5A of the front unit is connected to an input terminal of the impedance converter 21A of the front unit. An output terminal of the impedance converter 21A is connected to a fixed electrode 13A of the rear unit and a diaphragm 11A of the rear unit is connected to an input terminal of the impedance converter 22A of the rear unit.

In FIG. 4, an output terminal of the impedance converter 22 of the upper capacitor microphone unit serves as a hot-side output terminal for balanced output while an output terminal of the impedance converter 22A of the lower capacitor microphone unit serves as a cold-side output terminal for balanced output. The hot-side and the cold-side output terminals are each connected to a microphone cable via a connector and a ground side is connected to a shielding cable of the microphone cable. Thus, a balanced acoustic signal is output. As described above, the example illustrated in FIG. 4 includes two capacitor microphone units having the described structures in a pair. The electro-acoustic converter in the respective capacitor microphone units are connected in series and in an electrically opposite manner. Thus, balanced output can be taken from the pair of capacitor microphone units.

Figure 12:
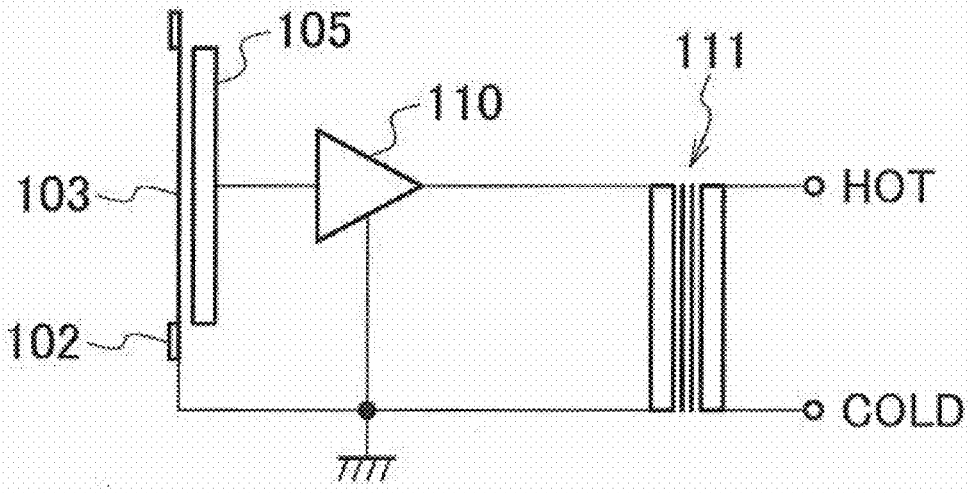
RELATED ART FIG.12
FIG. 12 is a circuit diagram exemplary depicting an electrical connection of the conventional example.

To achieve balanced output using the capacitor microphone unit according to the present invention, two capacitor microphone units in a pair as illustrated in FIG. 4 are not necessarily required. Instead, the balanced output can be achieved by connecting a transformer to an output circuit as illustrated in FIG. 12.

Although in the illustrated embodiment, two electro-acoustic converters are anteroposteriorly disposed on a single axis, the electro-acoustic converter is required to be provided in a plurality and the number thereof can be three or more.

Still, two electro-acoustic converters can provide sufficient effect and is preferable in terms of downsizing.

An innovative capacitor microphone can be obtained by incorporating the above described capacitor microphone units according to the present invention in a microphone casing.

With the present invention providing such an effect, a user-friendly capacitor microphone can be obtained and the application of capacitor microphones can be expanded.

What is claimed is:

1. A capacitor microphone unit comprising:

a casing;

a plurality of electro-acoustic converters anteroposteriorly disposed on the same axis in the casing; and a spacer dividing the electro-acoustic converters; wherein the electro-acoustic converters each includes:

a diaphragm;

a fixed electrode apart from the diaphragm for a certain distance and facing the diaphragm;

an impedance converter; and terminals that are respectively connected to the diaphragm and the fixed electrode, the diaphragm and the fixed electrode of each of the electro-acoustic converters are electrically insulated from the casing, and an output from the impedance converter connected to one of the electro-acoustic converters drives another one of the electro-acoustic converters.

2. The capacitor microphone unit according to claim 1, wherein the electro-acoustic converters are electret capacitor microphone units.

3. The capacitor microphone unit according to claim 1, wherein the diaphragm ring of each of the electro-acoustic converters except for one of the electro-acoustic converters that is disposed at front most position is thinner than the diaphragm ring of the one of the electro-acoustic converters disposed at the front most position, the diaphragm ring being fixed to the diaphragm.

4. A capacitor microphone unit comprising two capacitor microphone units according to claim 1, wherein a plurality of electro-acoustic converters in one of the two capacitor microphone units and a plurality of electro-acoustic converters in the other one of the two capacitor microphone units are connected in series while being electrically opposite from each other, and a balanced output is taken from the capacitor microphone unit with one of the two capacitor microphone units serving as a hot-side and the other one of the two capacitor microphone units serving as a cold-side.

5. A capacitor microphone comprising:

a casing; and the capacitor microphone unit according to claim 1 incorporated in the casing.

* * * * *